US006901891B2

(12) United States Patent
Suzuki et al.

(10) Patent No.: US 6,901,891 B2
(45) Date of Patent: Jun. 7, 2005

(54) FLUID PASSAGE STRUCTURE OF INTERNAL COMBUSTION ENGINE

(75) Inventors: Masao Suzuki, Nishikamo-gun (JP); Tatsuo Shimakawa, Kariya (JP)

(73) Assignees: Toyota Jidosha Kabushiki Kaisha, Toyota (JP); Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/694,954

(22) Filed: Oct. 29, 2003

(65) Prior Publication Data

US 2004/0083990 A1 May 6, 2004

(30) Foreign Application Priority Data

Oct. 31, 2002 (JP) ..... 2002-318049

(51) Int. Cl.[7] ..... F02F 1/14
(52) U.S. Cl. ..... 123/41.79; 123/193.3
(58) Field of Search ..... 123/41.79, 41.82 R, 123/41.82 A, 193.3

(56) References Cited

U.S. PATENT DOCUMENTS 4,436,066 A 3/1984 Formia et al.
4,944,265 A 7/1990 Davey
5,558,048 A * 9/1996 Suzuki et al. ..... 123/41.74
5,970,941 A 10/1999 Bock

FOREIGN PATENT DOCUMENTS

JP 55-160143 A 12/1980
JP 63-303266 A 12/1988
JP 10-159649 A 6/1998
JP 10-281290 A 10/1998
JP 2001-227410 A 8/2001

* cited by examiner

*Primary Examiner*—Andrew M. Dolinar
*Assistant Examiner*—Katrina Harris
(74) *Attorney, Agent, or Firm*—Kenyon & Kenyon

(57) ABSTRACT

In a fluid passage structure of an internal combustion engine wherein oil flows from an in-block flow passage formed in a cylinder block to an in-head flow passage formed in a cylinder head, a groove that is generally rectangular in cross section is so formed in a top face of the cylinder block as to extend from a position corresponding to an opening of the in-block flow passage formed in the top face to a position corresponding to an opening of the in-head flow passage formed in a bottom face of the cylinder head, by machining or the like. Thus, a flow passage arrangement in which the openings of the flow passages are offset from each other is allowed. As a result, the degree of freedom in designing the fluid passage structure is enhanced.

10 Claims, 9 Drawing Sheets

CROSS SECTION OF IN-BLOCK FLOW PASSEGE 12

CROSS SECTION OF GROOVE 13

FLUID PASSAGE STRUCTURE OF INTERNAL COMBUSTION ENGINE

INCORPORATION BY REFERENCE

The disclosure of Japanese Patent Application No. 2002-318049 filed on Oct. 31, 2002, including the specification, drawings and abstract is incorporated herein by reference in its entirety.

BACKGROUND OF THE INVENTION

1. Field of the Invention

The invention relates to a fluid passage structure of an internal combustion engine which enables fluid to flow through the interiors of a cylinder block and a cylinder head.

2. Description of the Related Art

Inside a cylinder head and a cylinder block of an internal combustion engine, fluid passages through which fluid including oil such as lubricant, coolant and the like flow are formed. In many of such internal combustion engines, as disclosed in Japanese Patent Application Laid-Open No. 63-303266, an in-block flow passage as a fluid passage formed in a cylinder block and an in-head flow passage as a fluid passage formed in a cylinder head are coupled to each other on an abutment plane defined by a bottom face of the cylinder head and a top face of the cylinder block. Thus, fluid flow between the cylinder block and the cylinder head.

In such a fluid passage structure of an internal combustion engine, an opening position of an in-block flow passage on a top face of a cylinder block needs to coincide with an opening position of an in-head flow passage on a bottom face of a cylinder head so as to ensure that the in-block flow passage communicates with the in-head flow passage. However, since the cylinder block and the cylinder head are complicated in structure, the degree of freedom in arranging the in-block flow passage and the in-head flow passage is low, and it is not easy to design the fluid passage structure such that the opening positions of the flow passages coincide with each other. Also, due to such a restriction on arrangement of the flow passages, it is sometimes inevitable to form the in-block flow passage and the in-head flow passage obliquely with respect to the top face of the cylinder block and the bottom face of the cylinder head respectively. As a result, for example, oblique holes need to be drilled. This constitutes a factor which makes it difficult to manufacture an internal combustion engine having the fluid passage structure as described above.

In addition, such a fluid passage structure of an internal combustion engine may be susceptible to a problem that will be described below. In a fluid passage structure as described above, it is sometimes required that the flow rate of fluids flowing between a cylinder block and a cylinder head be restricted. The flow rate can be restricted by adjusting flow areas of an in-block flow passage and an in-head flow passage. However, if those flow areas are made smaller than a certain area, elongated holes of a great length need to be drilled, for example. This makes it difficult to form the in-block flow passage and the in-head flow passage. For example, as shown in FIG. 12, it is also contemplable to mount an in-block flow passage 191 or an in-head flow passage 192 (the in-block flow passage 191 in an example illustrated in FIG. 12) with an orifice 194 in which an elongated hole 193 is formed, and to restrict the flow rate of fluids by throttling part of the flow passage. In such a case, however, the orifice 194 needs to be prepared as a separate piece. As a result, an increase in manufacturing cost is ineludible.

Further, according to the fluid passage structure of the internal combustion engine disclosed in the aforementioned patent document, as shown in FIG. 13, a communication hole 204 of a head gasket interposed between an in-block flow passage 201 and an in-head flow passage 202 is formed to be small in diameter, so that the communication hole 204 substantially acts as a throttle for restricting the flow rate of fluid. With this arrangement, the flow rate is restricted without increasing the number of parts used. However, considering the fact that the head gasket 203 has a thin flat shape, it is feared that the peripheral portion of the communication hole 204 will deform due to the fluid flow pressure applied thereto, as represented by the dashed line in FIG. 13. In particular, if adopted as a flow passage delivering an oil, such as a lubricating oil, the flow pressure applied to the peripheral portion aforementioned may become as high as 1 MPa, for example, during a cold start of the engine where the viscosity of the oil is still high. For this reason, the above-described structure makes it difficult to maintain a sufficient durability of head gasket 203.

Thus, none of fluid passage structures developed or proposed so far enables to favorably restrict the flow rate without causing problems, such as a reduction in the durability of the head gasket as described above.

SUMMARY OF THE INVENTION

It is an object of the invention to provide a fluid passage structure that is capable of enhancing a degree of freedom in designing fluid passages formed inside a cylinder head and a cylinder block.

In a first aspect of the invention, there is provided a fluid passage structure of an internal combustion engine, comprising an in-block flow passage having a first opening position on a top face of a cylinder block, an in-head flow passage having a second opening position on a bottom face of a cylinder head, wherein the first opening position and the second opening position are offset from each other, and a groove that is formed in at least one of the top face and the bottom face and that is provided so as to establish communication between the in-block flow passage and the in-head flow passage.

According to the first aspect, the in-block flow passage and the in-head flow passage communicate with each other through the groove that is formed in at least one of the top face of the cylinder block and the bottom face of the cylinder head. Therefore, it is not required that the opening positions of the flow passages coincide with each other. Hence, the degree of freedom in arranging the flow passages inside the cylinder block and the cylinder head is enhanced. As a result, the processes of designing and manufacturing the flow passages can be facilitated.

In the first aspect of the invention, a flow area of at least part of the groove may be designed to be smaller than an opening area of the in-block flow passage on the top face and an opening area of the in-head flow passage on the bottom face. Thus, the groove establishing communication between the in-block flow passage and the in-head flow passage is provided with a portion that is reduced in flow area. Therefore, the groove functions as a throttle for restricting a flow rate of a fluid flowing through fluid passages. Accordingly, the flow rate of the fluid can be suitably restricted without causing inconveniences such as an increase in the number of parts, a deterioration in workability, a decrease in durability of the head gasket, and the like.

In the above aspect of the invention, the groove may be provided with a throttle for restricting a flow rate of a fluid.

Thus, the in-block flow passage and the in-head flow passage communicate with each other through the groove that is formed in at least one of the top face of the cylinder block and the bottom face of the cylinder head. Therefore, it is not required that the opening positions of the flow passages coincide with each other. Thus, the degree of freedom in arranging the flow passages inside the cylinder block and the cylinder head is enhanced. As a result, the processes of designing and manufacturing the flow passages can be facilitated. In addition, according to the aforementioned aspect, since the groove establishing communication between the in-block flow passage and the in-head flow passage is provided with the throttle for restricting a flow rate of a fluid flowing through the fluid passages. Thus, the flow rate of the fluid can be suitably restricted without causing inconveniences such as an increase in the number of parts, a deterioration in workability, a decrease in durability of the head gasket, and the like.

In the above aspect of the invention, the in-block flow passage and the in-head flow passage may be formed as fluid passages through which oil flows. Thus, in the fluid passage structure for enabling flow of oil that is used to lubricate various portions of an engine or to operate a hydraulically operated unit, the freedom of degree in arranging oil passages can be enhanced, and the amount of oil can be suitably restricted.

In the above aspect of the invention, the in-block flow passage and the in-head flow passage may be formed as fluid passages through which coolant flows. Thus, in the fluid passage structure for enabling flow of coolant for cooling an engine, the freedom of degree in arranging coolant passages can be enhanced, and the amount of coolant can be suitably restricted.

In the above aspect of the invention, the fluid passage structure may further comprises a head gasket that is provided between the cylinder block and the cylinder head and that has a communication hole. The groove is provided in one of the cylinder block and the cylinder head. The communication hole is provided at a position corresponding to one of the first opening position and the second opening position that is provided on the other side of the groove. Thus, since the head gasket has the communication hole, communication between the in-block flow passage and the in-head flow passage can be established through the groove.

In the above aspect of the invention, an opening diameter of the communication hole may be designed to be larger than an opening diameter of one of the first opening position and the second opening position that is provided on the other side of the groove. Thus, the opening diameter of the communication hole is designed to be larger than the one of the opening diameter of the first opening position and the opening diameter of the second opening position, so that the head gasket is supported from the back side against the flow of the fluid. Hence, as for a peripheral region of the communication hole as well, the head gasket can be suitably prevented from being deformed due to the flow pressure of the fluid flowing through the communication hole.

In the above aspect of the invention, a bead may be provided so as to protrude from at least one face of the head gasket, and to surround the opening position of the in-block flow passage, the opening position of the in-head flow passage, and the groove. Thus, if the bead is formed in the head gasket, contacting surface pressures between the cylinder block and the head gasket and between the cylinder head and the head gasket are increased. Hence, oil can be sufficiently inhibited from leaking from a coupling portion of the flow passages as mentioned above.

In the above aspect of the invention, the first recess portion that is larger in area than one of the first opening position and the second opening position and that has a predetermined depth may be formed in said one of the first opening position and the second opening position. The groove may have a communication portion and a second recess portion. The communication portion may be provided so as to establish communication between the first recess portion and the second recess portion. The second recess portion may be designed to be provided on the same side as one of the cylinder block and the cylinder head that is provided with the first recess portion, to be located adjacent to the first recess portion, to be formed at a position corresponding to one of the first opening position and the second opening position that is provided on the other side of one of the cylinder block and the cylinder head that is provided with the first recess portion, to be larger in opening area than one of the first opening position and the second opening position to which the second recess portion corresponds, and to have a predetermined depth. Thus, the flow rate of oil flowing through the fluid passages can be suitably restricted while an increase in manufacturing cost is suppressed.

In the above aspect of the invention, the groove may constant in width and has a bottom face constituting part of a lateral face of a circular cylinder. Thus, the flow rate of oil flowing through the fluid passages can be suitably restricted while an increase in manufacturing cost is suppressed.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE PREFERRED EMBODIMENT

A first embodiment as a concrete form of a fluid passage structure of an internal combustion engine in accordance with the invention will be described hereinafter with reference to FIGS. 1 to 5.

This embodiment is a concrete form of the invention as a fluid passage structure for enabling circulation of oil that is used to lubricate various portions of an internal combustion engine. This fluid passage structure is so constructed as to include an in-block flow passage formed in a cylinder block and an in-head flow passage formed in a cylinder head. The in-block flow passage and the in-head flow passage communicate with each other on opposed faces of the cylinder head and the cylinder block. Oil pressurized by an oil pump flows from the in-block flow passage to the in-head flow passage.

Figure 1:
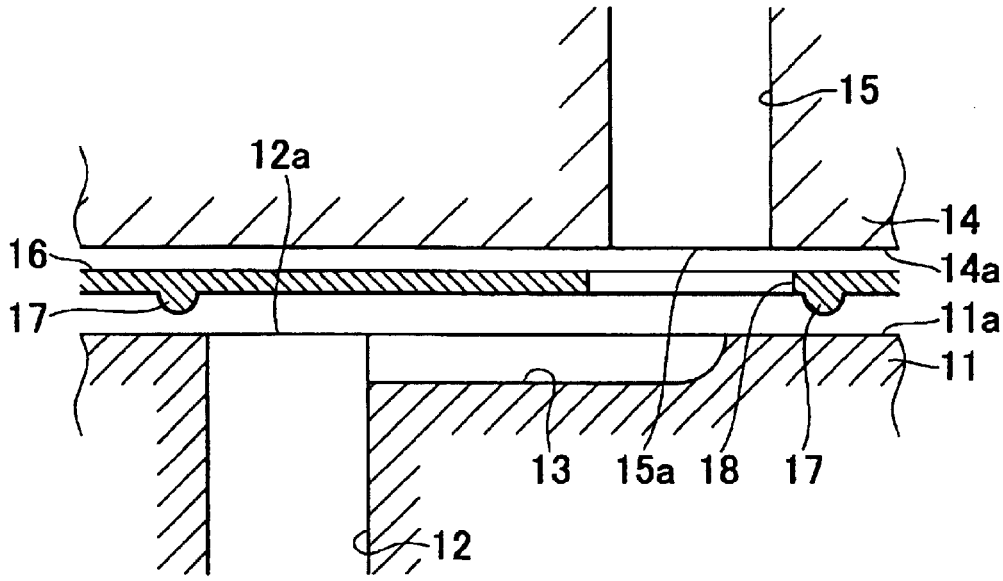
FIG. 1 is a cross-sectional view showing part of a cross-sectional structure of a lateral portion of a fluid passage structure in accordance with a first embodiment of the invention.

FIG. 1 shows an enlarged cross-sectional structure of an abutment region of a cylinder block 11 and a cylinder head 14 that are provided with connecting portions for oil passages constructed as described above. As shown in FIG. 1, a head gasket 16 is interposed between opposed faces of the cylinder block 11 and the cylinder head 14, namely, between a top face 11*a* of the cylinder block 11 and a bottom face 14*a* of the cylinder head 14.

An in-block flow passage 12 leading to an opening 12*a* in the top face 11*a* and an in-head flow passage 15 leading to an opening 15*a* in the bottom face 14*a* are formed inside the cylinder block 11 and the cylinder head 14 respectively. As shown in FIG. 1, the opening 12*a* of the in-block flow passage 12 and the opening 15*a* of the in-head flow passage 15 are offset from each other.

The in-block flow passage 12 extends downwards from the top face 11*a* of the cylinder block 11 perpendicularly to the top face 11*a*. The in-head flow passage 15 extends upwards from the bottom face 14*a* of the cylinder head 14 perpendicularly to the bottom face 14*a*. The in-block flow passage 12 and the in-head flow passage 15 are circular in cross section. Both the flow passages 12 and 15 are identical in shape and size in cross section. The in-block flow passage 12 and the in-head flow passage 15 are formed by machining after the cylinder block 11 and the cylinder head 14 have been cast respectively.

A groove 13, which is generally rectangular in cross section, is formed in the top face 11*a* of the cylinder block 11. In the top face 11*a* of the cylinder block 11, the groove 13 extends from a position corresponding to the opening 12*a* of the in-block flow passage 12 to a position corresponding to the opening 15*a* of the in-head flow passage 15. In this embodiment, the groove 13 is formed by machining after the in-block flow passage 12 has been formed.

A communication hole 18 is formed in the head gasket 16 at a position corresponding to the opening 15*a* of the in-head flow passage 15. The communication hole 18 establishes communication between the in-head flow passage 15 and the groove 13 that is formed in the top face 11*a* of the cylinder block 11. Thus, the groove 13 establishes communication between the in-block and in-head flow passages 12 and 15 whose openings 12*a* and 15*a* are offset from each other.

In addition, a convexly protruding bead 17 is formed in a face of the head gasket 16 on the side of the cylinder block 11 in such a manner as to surround a region corresponding to the opening 12*a* of the in-block flow passage 12, the opening 15*a* of the in-head flow passage 15, and the groove 13.

Figure 2:
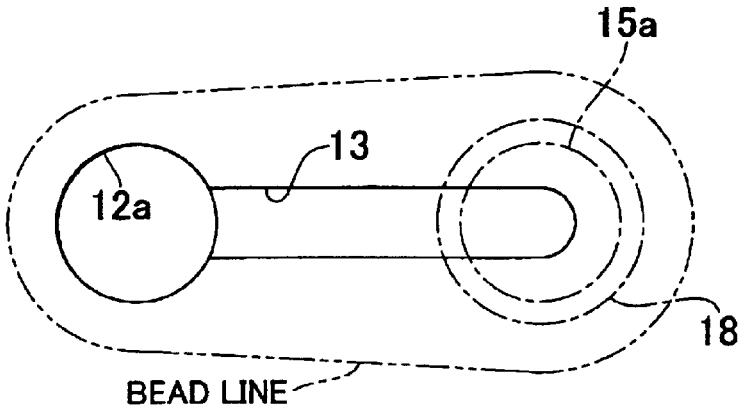
FIG. 2 is a plan view showing part of a plane structure of a top face of a cylinder block of the first embodiment of the invention.

FIG. 2 shows a plane structure of the top face 11*a* of the cylinder block 11 in which the groove 13 is formed. Referring to FIG. 2, on the top face 11*a* of the cylinder block 11, a position corresponding to the opening 15*a* of the in-head flow passage 15 and a position corresponding to the communication hole 18 of the head gasket 16 are indicated by alternate long and short dash lines. In FIG. 2, a line extending along a position where the bead 17 formed on the head gasket 16 is disposed, namely, a bead line is indicated by an alternate long and two short dashes line.

As shown in FIG. 2, the communication hole 18 of the head gasket 16 is larger in inner diameter than the in-head flow passage 15. The bead 17 on the head gasket 16 extends generally elliptically as is apparent from FIG. 2.

Figure 3:
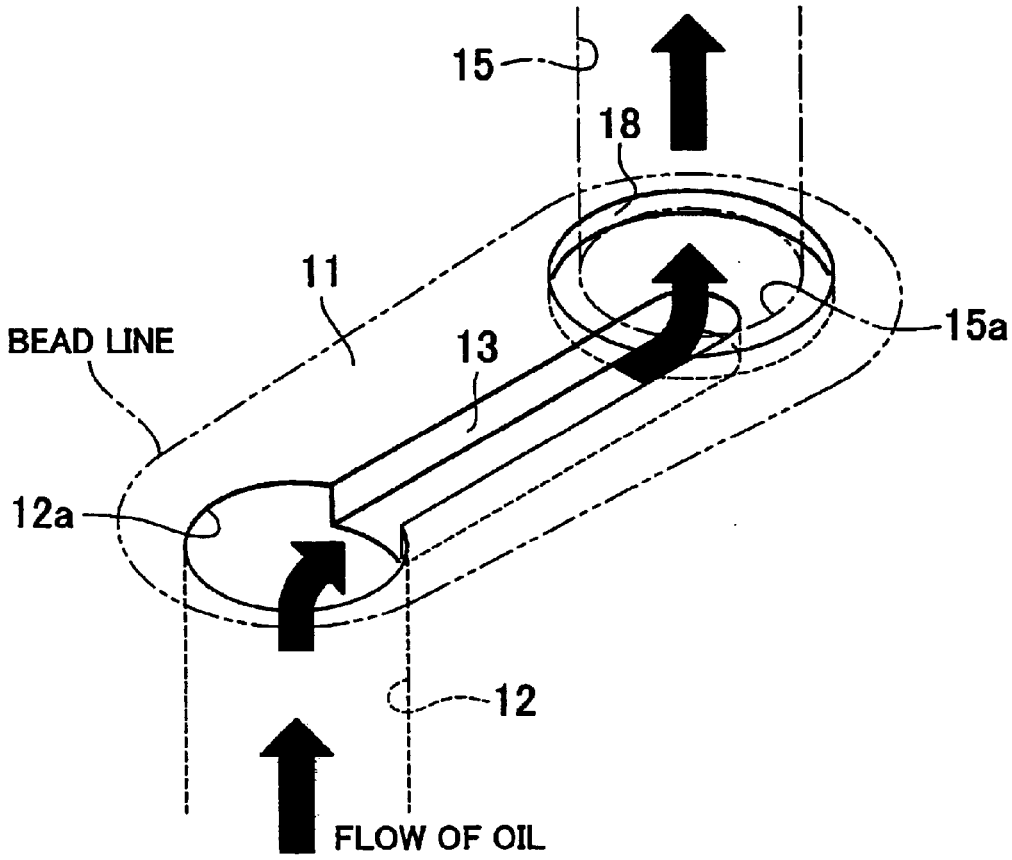
FIG. 3 is a perspective view showing part of a perspective structure of the fluid passage structure of the first embodiment of the invention.
Figure 4A:
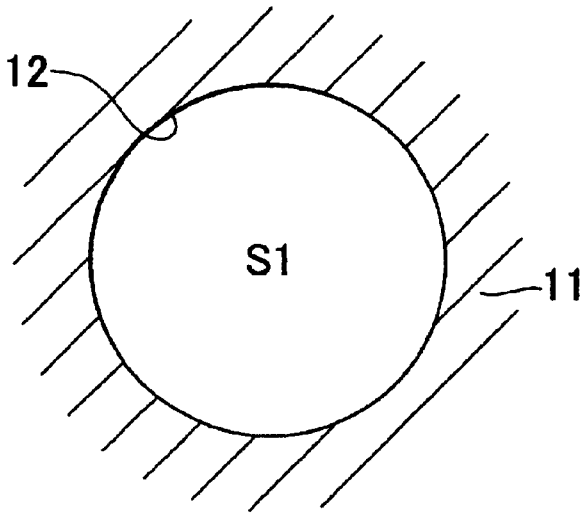
FIG. 4A, FIG. 4B are a cross-sectional view of an in-block flow passage (FIG. 4A) and a groove (FIG. 4B) of the first embodiment of the invention.
Figure 4B:
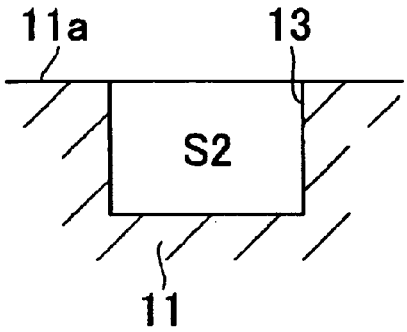

In FIG. 3, a mode in which oil flows through an oil passage thus constructed is indicated by arrows. As shown in FIG. 3, oil that has been conveyed through the in-block flow passage 12 flows through the groove 13 formed in the top face 11*a* of the cylinder block 11, and is conveyed to the in-head flow passage 15 through the communication hole 18 formed in the head gasket 16. By thus providing the top face 11*a* of the cylinder block 11 with the groove 13, a flow passage arrangement in which the opening 12*a* of the in-block flow passage 12 and the opening 15*a* of the in-head flow passage 15 are offset from each other is allowed. Hence, the degree of freedom in arranging the flow passages inside the cylinder block 11 and the cylinder head 14 is enhanced. As a result, the processes of designing and manufacturing the fluid passage structure can be facilitated.

In the construction described above, oil flows between the opposed faces of the cylinder block 11 and the cylinder head 14 through the groove 13. In the first embodiment, however, the bead 17 is so formed as to surround a region stretching around the openings 12*a* and 15*a* of the flow passages 12 and 15 and the groove 13. Along the periphery of that region, therefore, the contact surface pressure between the cylinder block 11 and the head gasket 16 and the contact surface pressure between the 14 and the 16 are made relatively high due to the presence of the bead 17. Thus, oil can be sufficiently inhibited from leaking from a coupling portion of the flow passages 12 and 15.

Furthermore, in the first embodiment, the groove 13 also functions as a throttle for restricting a flow rate of oil flowing from the in-block flow passage 12 to the in-head flow passage 15. That is, in the first embodiment, a flow area S2 of the groove 13 is designed to be sufficiently smaller than a flow area S1 of the in-block flow passage 12, as is apparent from FIG. 4. Thus, the flow rate of oil to be conveyed to the in-head flow passage 15 through the groove 13 can be easily restricted without increasing the number of parts. Dimensions of the groove 13, namely, a depth, a width, a length and the like of the groove 13 are suitably set such that the flow rate of oil can be restricted as desired. In other words, the flow area S2 of the groove 13 is suitably set such that the flow rate of oil can be restricted as desired.

As described above, the cross sections of the in-block flow passage 12 and the in-head flow passage 15 are identical in shape and dimension. The flow passages 12 and 15 are constant in cross section as far as the openings 12*a* and 15*a*, respectively. Accordingly, the flow area S2 of the groove 13 is designed to be smaller than an opening area (S1) of the in-block flow passage 12 on the top face 11*a* and an opening area (S1) of the in-head flow passage 15 on the bottom face 14*a*.

Figure 5:
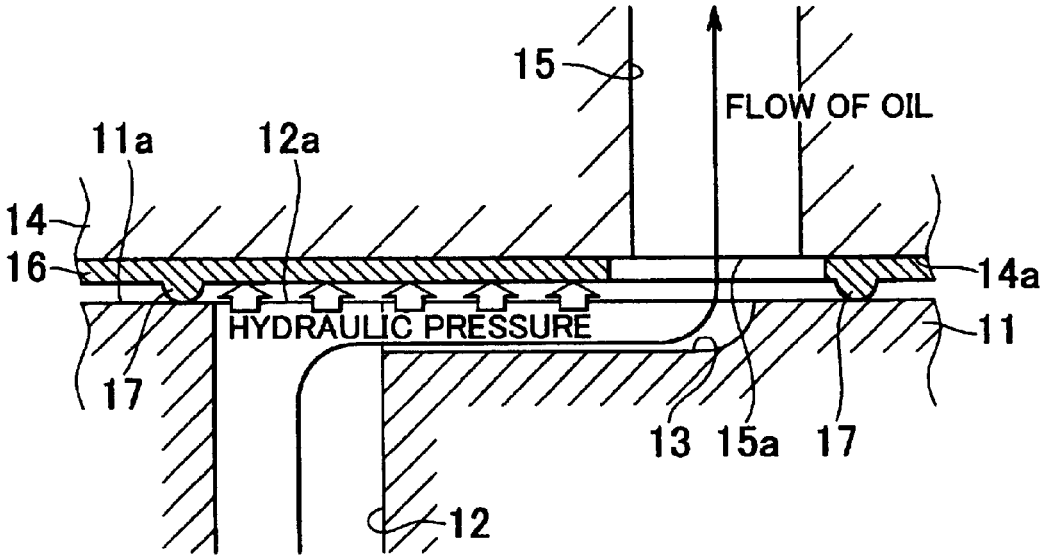
FIG. 5 is a cross-sectional view showing part of the cross-sectional structure of the lateral portion of the fluid passage structure in accordance with the first embodiment of the invention.

In the flow passage structure described above, since oil flows between the opposed faces of the cylinder block 11 and the cylinder head 14, a pressure of oil (hydraulic pressure) flowing through the groove 13 and the like is applied to a surface of the head gasket 16, as is apparent from FIG. 5. Especially on the surface of the head gasket 16 corresponding to a region facing the opening 12*a* of the in-block flow passage 12, the head gasket 16 faces flow of oil in the in-block flow passage 12 and is directly exposed to a flow pressure thereof. Therefore, a higher pressure is applied to the surface of the head gasket 16 in this region.

In the first embodiment, however, in all the regions of the head gasket 16 facing the flow passages, the face of the head gasket 16 on the side of the cylinder head 14 abuts on the bottom face 14*a* of the cylinder head 14, as is apparent from FIG. 5. Hence, a hydraulic pressure applied to the head gasket 16 can be supported from the back side thereof. Consequently, the head gasket 16 can be suitably inhibited from being deformed due to application of a hydraulic pressure.

In the first embodiment, the communication hole 18 of the head gasket 16, which is provided at the position corresponding to the opening 15*a* of the in-head flow passage 15, is larger in diameter than the opening 15*a*. Thus, the head gasket 16 is not exposed to flow of oil passing through the communication hole 18 and the opening 15*a*. Hence, in a peripheral region of the communication hole 18 as well, the head gasket 16 can be suitably prevented from being deformed due to a flow pressure of oil flowing through the communication hole 18. In the first embodiment, in consideration of a tolerance in mounting the head gasket 16 on the cylinder head 14, the diameter of the communication hole 18 is so set as to ensure that the entire circumference of the communication hole 18 is located outside an outer circumference of the opening 15*a*.

According to the flow passage structure for the internal combustion engine in accordance with the first embodiment described above, the following effects can be achieved.

As the first effect of the first embodiment, the opening 12*a* of the in-block flow passage 12 and the opening 15*a* of the in-head flow passage 15 communicate with each other through the groove 13 formed in the top face 11*a* of the cylinder block 11. Hence, a flow passage arrangement in which the openings 12*a* and 15*a* are offset from each other is allowed. Thus, the freedom in arranging the flow passages inside the cylinder block 11 and the cylinder head 14 is enhanced. As a result, the processes of designing and manufacturing the fluid passage structure can be facilitated.

As the second effect of the first embodiment, the flow area S2 of the groove 13 is designed to be smaller than the flow area S1 of the in-block flow passage 12 that is located upstream of a flow path of oil. Thus, the flow rate of oil flowing through fluid passages can be suitably restricted while an increase in manufacturing cost is suppressed.

As the third effect of the first embodiment, the bead 17 is so provided on the head gasket 16 as to surround the region stretching around the opening 12*a* of the in-block flow passage 12, the opening 15*a* of the in-head flow passage 15, and the groove 13. Thus, despite the construction in which oil flows between the opposed faces of the cylinder block 11 and the cylinder head 14, namely, between the top face 11*a* of the cylinder block 11 and the bottom face 14*a* of the cylinder head 14, oil can be suitably inhibited from leaking.

As the fourth effect of the first embodiment, in the region facing the oil flow passages (the opening 12*a* of the in-block flow passage 12 and the groove 13), the back face of the head gasket 16 abuts on the bottom face 14*a* of the cylinder head 14. Therefore, the head gasket 16 can be suitably inhibited from being deformed due to a hydraulic pressure.

As the fifth effect of the first embodiment, the communication hole 18 of the head gasket 16 is so formed to be larger than the opening 15*a* of the in-head flow passage 15, which faces the communication hole 18. Therefore, the head gasket 16 can be suitably inhibited from being deformed due to a flow pressure of oil flowing through the communication hole 18.

A fluid passage structure that is substantially the same as that of the aforementioned embodiment can be manufactured more easily by changing a mode of forming a groove for establishing communication between the in-block and in-head flow passages 12 and 15 whose openings 12*a* and 15*a* are disposed offset from each other, as will be described below. In first to third modification examples to be described below, the cylinder head 14 and the head gasket 16 can be constructed substantially in the same manner as in the first embodiment.

Next, the first modification example of the invention will be described.

If the groove is formed in the top face 11*a* while casting the cylinder block 11, machining associated with formation of the groove can be omitted. Thus, a fluid passage structure that is substantially the same as in the first embodiment can be manufactured more easily.

Figure 6:
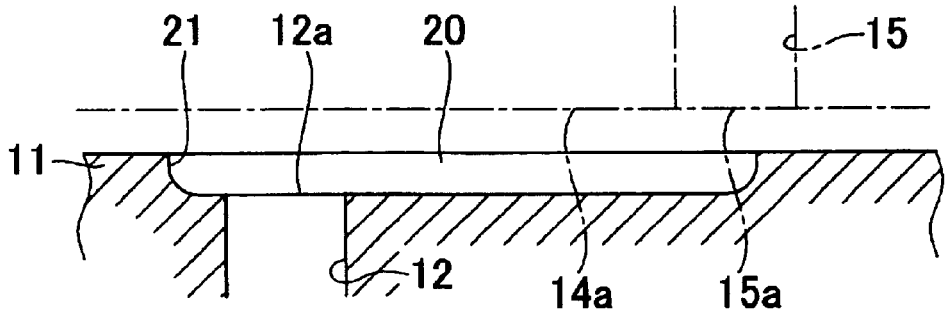
FIG. 6 is a cross-sectional view showing part of a cross-sectional structure of a lateral portion of a first modification example of the invention.

As an exemplary fluid passage structure having a groove 20 formed as described above, FIG. 6 shows an enlarged cross-sectional structure of the cylinder block 11 in the vicinity of the groove 20. Referring to FIG. 6, the bottom face 14*a* of the cylinder head 14 and the in-head flow passage 15 are indicated by alternate long and short dash lines. If a convex portion corresponding to the groove 20 is provided at a suitable position of a mold of the cylinder block 11, the groove 20 can be formed while casting the cylinder block 11. After the cylinder block 11 has been cast, the in-block flow passage 12 is formed at a predetermined position by machining or the like, whereby a fluid passage structure that is substantially the same as in the first embodiment is manufactured.

Figure 7:
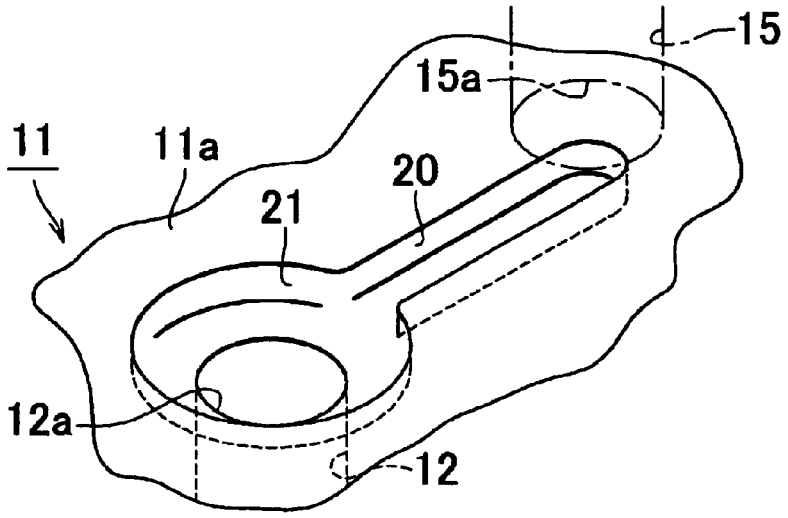
FIG. 7 is a perspective view showing part of a perspective structure of a top face of a cylinder block of the first modification example of the invention.

Because a precision in casting is lower than a precision in machining or the like, the groove 20 may be misplaced to such an extent that good communication with the opening 12*a* of the in-block flow passage 12 cannot be ensured. In this example, therefore, as shown in FIG. 7, a recess portion 21 is formed as one portion of the groove 20, and around the position where the opening 12*a* of the in-block flow passage 12 is formed, while casting the cylinder block 11.

The recess portion 21 has a bottom face that is parallel to the top face 11*a* of the cylinder block 11. The bottom face of the recess portion 21 is so formed to be sufficiently larger in diameter than the opening 12*a*. If a diameter of the bottom face of the recess portion 21 is made larger than the sum of a diameter of the opening 12*a* and a dimensional tolerance for casting, the opening 12*a* of the in-block flow passage 12 can be reliably located within the bottom face despite the dimensional tolerance for casting. Because the recess portion 21 is formed integrally with the groove 20, provision of the recess portion 21 can reliably ensure communication between the opening 12*a* of the in-block flow passage 12 and the groove 20.

Next, the second modification example of the invention will be described.

A fluid passage structure that is substantially the same as in the first embodiment can be manufactured relatively easily according to the following mode as well.

Figure 8:
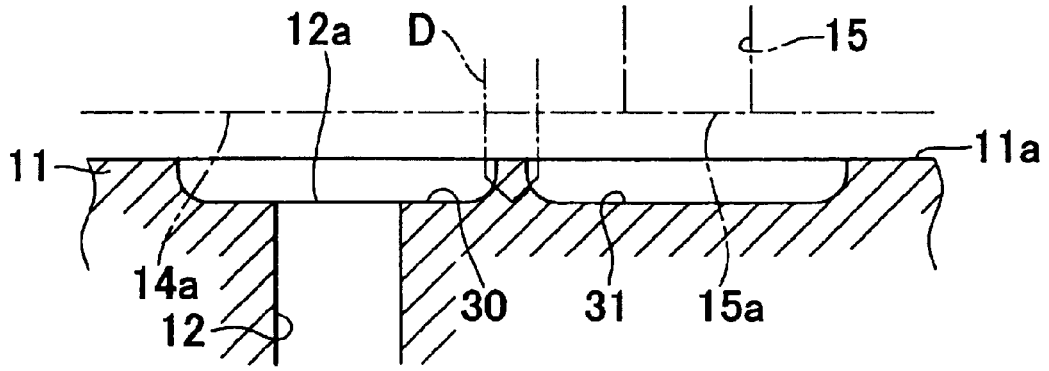
FIG. 8 is a cross-sectional view showing part of a cross-sectional structure of a lateral portion of a second modification example of the invention.

In this example, while manufacturing the cylinder block 11, recess portions 30 and 31 as shown in FIG. 8 are formed in the top face 11*a* of the cylinder block 11 at a position corresponding to the opening 12*a* of the in-block flow passage 12 and at a position corresponding to the opening 15*a* of the in-head flow passage 15, respectively. As is the case with the recess portion 21 of the aforementioned first modification example, each of the recess portions 30 and 31 has a flat bottom face that is sufficiently larger in diameter than a corresponding one of the openings 12*a* and 15*a*. The recess portions 30 and 31 are formed such that their peripheral edges are contiguous to each other.

Furthermore, in this example, after the recess portions 30 and 31 have been integrally formed in the top face 11*a* of the cylinder block 11 by casting, the in-block flow passage 12 is formed, while establishing communication between the recess portions 30 and 31 by machining. If a minimum distance between the peripheral edges of the recess portions 30 and 31 is sufficiently short, communication between them can be established by machining, for example, by means of a drill D.

Figure 9:
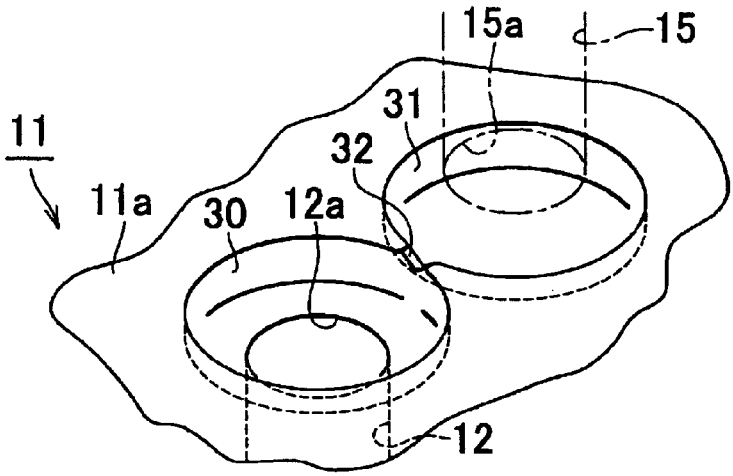
FIG. 9 is a perspective view showing part of a perspective structure of a top face of a cylinder block of the second modification example of the invention.

A communication portion 32 thus formed by machining and the recess portions 30 and 31 constitute a groove that is formed in the top face 11*a* of the cylinder block 11 as shown in FIG. 9. The groove is locally reduced in flow area in the communication portion 32, and can function as a throttle for restricting a flow rate of oil flowing from the in-block flow passage 12 to the in-head flow passage 15. If the groove is thus formed according to the mode described above, a fluid passage structure that is substantially the same as in the first embodiment can be manufactured only by simple machining.

If a groove is partially reduced in flow area as in the case of the second modification example, the groove can function as a throttle even though the groove is not reduced in flow area along an entire length thereof. That is, it is appropriate that the groove be at least partially smaller in flow area than an opening area of the in-block flow passage 12 on the top face 11 a of the cylinder block 11 and an opening area of the in-head flow passage 15 on the bottom face 14*a* of the cylinder head 14. Thus, the flow rate of oil flowing through the fluid passages can be suitably restricted while suppressing an increase in manufacturing cost.

Next, the third modification example will be described.

Furthermore, according to a mode to be described below, a fluid passage structure that is substantially the same as in the first embodiment can be manufactured by relatively simple machining.

Figure 10:
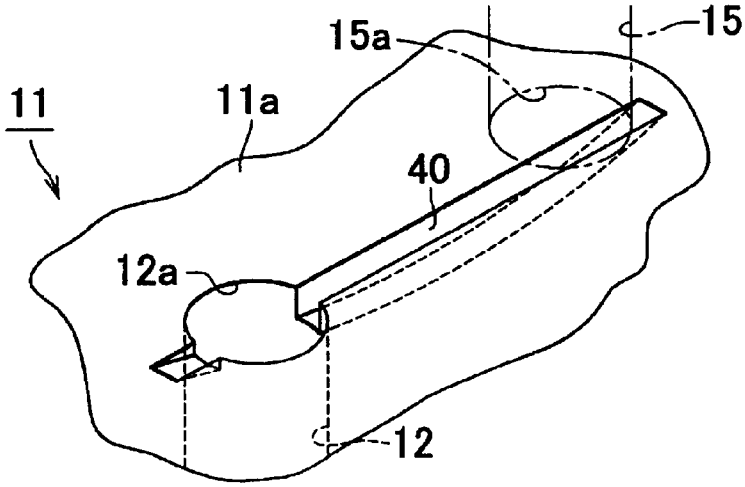
FIG. 10 is a perspective view showing part of a perspective structure of a top face of a cylinder block of a third modification example of the invention.
Figure 11:
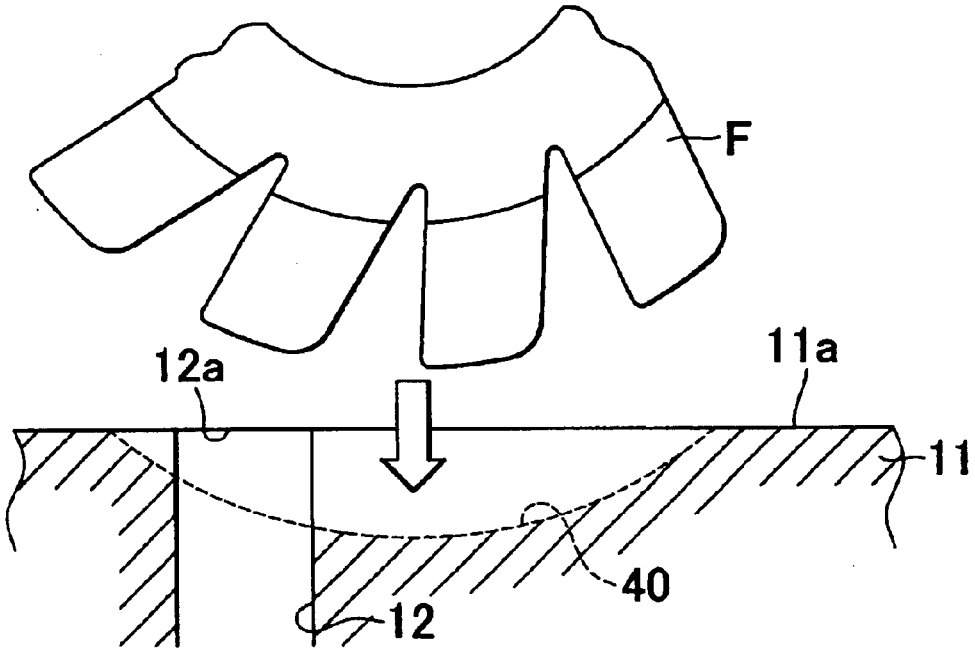
FIG. 11 is a cross-sectional view showing a mode of a manufacturing process of the third modification example of the invention.
Figure 12:
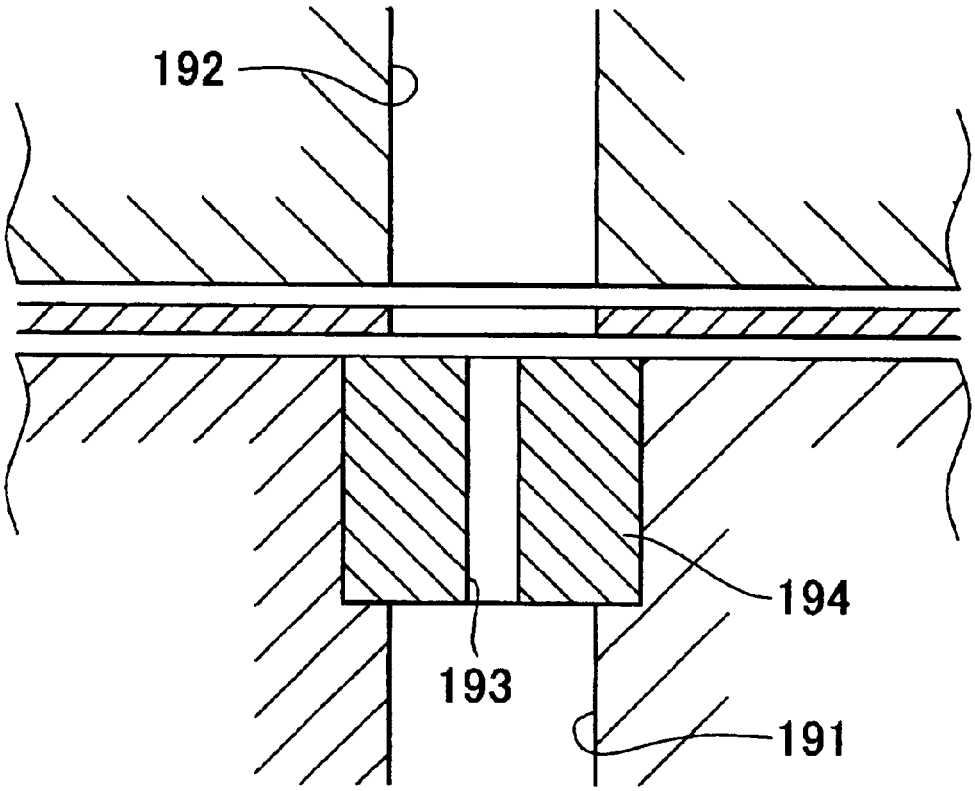
FIG. 12 RELATED ART
FIG. 12 is a cross-sectional view showing part of a lateral portion of a fluid passage structure which is constructed in accordance with the related art and which has an orifice.
Figure 13:
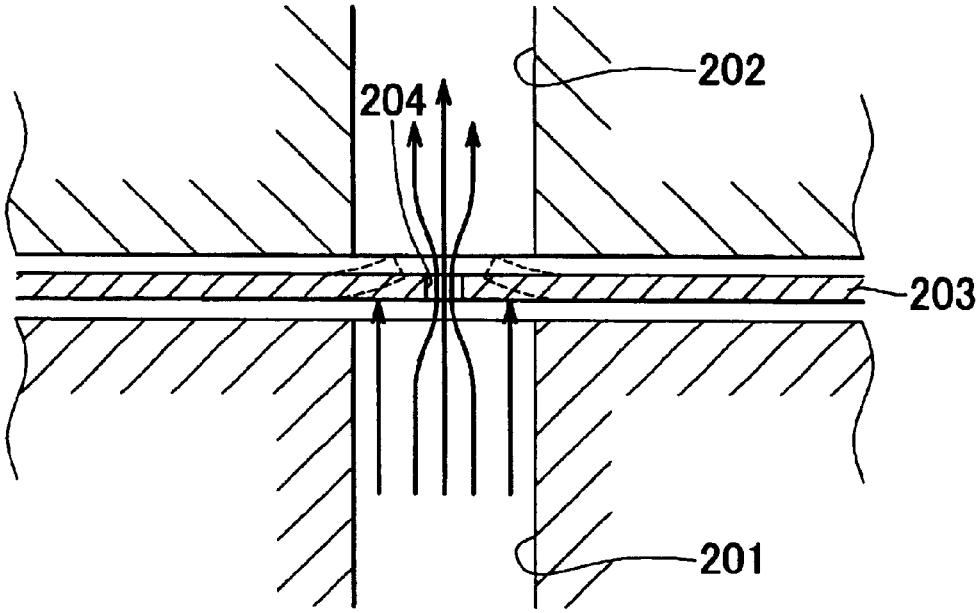
FIG. 13 RELATED ART
FIG. 13 is a cross-sectional view showing part of a cross-sectional structure of a lateral portion of the fluid passage structure which is constructed in accordance with the related art and in which a communication hole of a head gasket is throttled.

In this example, a groove 40 through which the opening 12*a* of the in-block flow passage 12 and the opening 15*a* of the in-head flow passage 15 communicate with each other is formed in a shape as shown in FIG. 10. Namely, the groove 40 is so formed as to be constant in width and to have an arcuate cross-sectional shape along a direction in which the groove 40 extends. The groove 40 of this shape can be formed in one step using a slotting cutter F or the like, for example, as is apparent from FIG. 11. Of course, if dimensions of the groove 40 thus formed are suitably set, the groove 40 can function as a throttle for restricting a flow rate of oil flowing therethrough.

The embodiment described above can also be modified as follows.

In the aforementioned embodiment, the communication hole 18 of the head gasket 16 is larger in diameter than the opening 15*a* of the in-head flow passage 15. However, if sufficient precision can be ensured in mounting the head gasket 16 on the cylinder head 14, the peripheral region of the communication hole 18 can be prevented from being exposed to flow of oil passing through the opening 15*a* even though the communication hole 18*a* and the opening 15*a* are equal in diameter. In such a case, therefore, if the communication hole 18 is equal in diameter to or larger in diameter than the opening 15*a*, the head gasket 16 can be suitably inhibited from being deformed due to a flow pressure in the peripheral region of the communication hole 18.

In the aforementioned embodiment, the bead 17 is provided on the face of the head gasket 16 on the side of the cylinder block 11. However, if the amount of oil leaking from the groove or the like is sufficiently small in the first place, installation of the bead 17 is not indispensable.

It is also appropriate that a groove through which the opening 12*a* of the in-block flow passage 12 communicates with the opening 15*a* of the in-head flow passage 15 be formed in the bottom face 14*a* of the cylinder head 14. It is also appropriate that a groove extending from the opening 12*a* of the in-block flow passage 12 to a certain position between the opening 12*a* of the in-block flow passage 12 and the opening 15*a* of the in-head flow passage 15 be formed in the top face 11*a* of the cylinder block 11, and that a groove extending from the position to the opening 15*a* of the in-head flow passage 15 be formed in the bottom face 14*a* of the cylinder head 14. In this case as well, if a communication hole is formed in the head gasket at the aforementioned position, communication between the openings 12*a* and 15*a* that are disposed offset from each other can be established.

The groove through which the opening 12*a* of the in-block flow passage 12 and the in-head flow passage 15 communicate with each other may be suitably changed in shape or mode of formation. That is, it is not required that this groove be identical in shape or mode of formation with any of the grooves of the aforementioned embodiment and the modification examples thereof. In short, the aforementioned first effect can be achieved as long as the groove is formed in at least one of the top face 11*a* of the cylinder block 11 and the bottom face 14*a* of the cylinder head 14 while being designed to establish communication between the openings 12*a* and 15*a* that are disposed offset from each other. If the groove is partially provided with a portion that is smaller in flow area than an opening area of the in-block flow passage 12 on the top face 11*a* of the cylinder block 11 and an opening area of the in-head flow passage 15 on the bottom face 14*a* of the cylinder head 14, the aforementioned second effect can be achieved.

If there is no need to restrict a flow rate of oil, the aforementioned groove need not be at least partially provided with a portion that is smaller in flow area than the aforementioned opening areas of the flow passages 12 and 15. In this case as well, the aforementioned first effect can be achieved.

In the aforementioned embodiment and the modification examples thereof, the invention is applied to the fluid passage structure for enabling flow of oil that is used to lubricate various portions of an internal combustion engine. However, the invention can also be applied to such a fluid passage structure for an internal combustion engine as is designed to enable flow of a fluid other than oil, for example, coolant for cooling the engine.

What is claimed is:

1. A fluid passage structure of an internal combustion engine, comprising:

an in-block flow passage having a substantially circular first opening position on a top face of a cylinder block;

an in-head flow passage having a second opening position on a bottom face of a cylinder head, wherein the first opening position and the second opening position are offset from each other; and a groove that is formed in at least one of the top face and the bottom face and that is provided so as to establish communication between the in-block flow passage and the in-head flow passage.

2. The fluid passage structure according to claim 1, wherein a flow area of at least part of the groove is designed to be smaller than an opening area of the in-block flow passage on the top face and an opening area of the in-head flow passage on the bottom face.

3. The fluid passage structure according to claim 1, wherein the in-block flow passage and the in-head flow passage are formed as fluid passages through which oil flows.

4. The fluid passage structure according to claim 1, wherein the in-block flow passage and the in-head flow passage are formed as fluid passages through which coolant flows.

5. The fluid passage structure according to claim 1, further comprising a head gasket that is provided between the cylinder block and the cylinder head and that has a communication hole, wherein:

the groove is provided in one of the cylinder block and the cylinder head; and the communication hole is provided at a position corresponding to one of the first opening position and the second opening position that is provided on the other side of the groove.

6. A fluid passage structure of an internal combustion engine, comprising:

an in-block flow passage having a first opening position on a top face of a cylinder block;

an in-head flow passage having a second opening position on a bottom face of a cylinder head, wherein the first opening position and the second opening position are offset from each other;

a groove that is formed in at least one of the top face and the bottom face and that is provided so as to establish communication between the in-block flow passage and the in-head flow passage; and a head gasket that is provided between the cylinder block and the cylinder head and that has a communication hole, wherein;

the groove is provided in one of the cylinder block and the cylinder head; and the communication hole is provided at a position corresponding to one of the first opening position and the second opening Position that is provided on the other side of the groove; and wherein an opening diameter of the communication hole is designed to be larger than an opening diameter of the one of the first opening position and the second opening position that is provided on the other side of the groove.

7. The fluid passage structure according to claim 5, wherein a bead is provided so as to protrude from at least one face of the head gasket, and to surround the opening position of the in-block flow passage, the opening position of the in-head flow passage, and the groove.

8. The fluid passage structure according to claim 1, wherein:

a first recess portion that is larger in opening area than one of the first opening position and the second opening position and that has a predetermined depth is formed in said one of the first opening position and the second opening position;

the groove has a communication portion and a second recess portion;

the communication portion is provided so as to establish communication between the first recess portion and the second recess portion; and the second recess portion is designed to be provided on the same side as one of the cylinder block and the cylinder head that is provided with the first recess portion, to be located adjacent to the first recess portion, to be formed at a position corresponding to one of the first opening position and the second opening position that is provided on the other side of one of the cylinder block and the cylinder head that is provided with the first recess portion, to be larger in opening area than one of the first opening position and the second opening position to which the second recess portion corresponds, and to have a predetermined depth.

9. The fluid passage structure according to claim 1, wherein the groove is constant in width and has a bottom face constituting part of a lateral face of a circular cylinder.

10. A fluid passage structure of an internal combustion engine, comprising:

an in-block flow passage having a first opening position on a top face of a cylinder block;

an in-head flow passage having a second opening position on a bottom face of a cylinder head, wherein the first opening position and the second opening position are offset from each other;

a groove that is formed in at least one of the top face and the bottom face and that is provided so as to establish communication between the in-block flow passage and the in-head flow passage;

a head gasket that is provided between the cylinder block and the cylinder head and that has a communication hole, wherein:

the groove is provided in one of the cylinder block and the cylinder head;

the communication hole is provided at a position corresponding to one of the first opening position and the second opening position that is provided on the other side of the groove; and an opening diameter of the communication hole is designed to be larger than an opening diameter of the one of the first opening position and the second opening position that is provided on the other side of the groove.

* * * * *